US007473006B1

(12) United States Patent
Bollman

(10) Patent No.: US 7,473,006 B1
(45) Date of Patent: Jan. 6, 2009

(54) ILLUMINATED LANDSCAPE EDGING SYSTEM

(76) Inventor: James Bollman, 15 Spinning Wheel Rd., Apt. 5B, Massapequa, NY (US) 11758

( * ) Notice: Subject to any disclaimer, the term of this patent is extended or adjusted under 35 U.S.C. 154(b) by 0 days.

(21) Appl. No.: 11/830,046

(22) Filed: Jul. 30, 2007

(51) Int. Cl.
*F21S 8/00* (2006.01)

(52) U.S. Cl. ..... 362/152; 362/153.1; 362/249

(58) Field of Classification Search ..... 362/152, 362/650, 652, 249, 565, 153.1; 47/33
See application file for complete search history.

(56) References Cited

U.S. PATENT DOCUMENTS 5,410,458 A 4/1995 Bell
5,438,804 A 8/1995 Reum et al.
6,162,515 A * 12/2000 Hill ..... 428/20
6,179,440 B1 * 1/2001 Palmer ..... 362/249
6,699,137 B2 * 3/2004 Szymanski ..... 473/169
7,114,826 B1 * 10/2006 Lilly ..... 362/146
7,347,006 B2 * 3/2008 Moriya et al. ..... 34/403
7,347,606 B1 * 3/2008 Patten ..... 362/565
2002/0106931 A1 * 8/2002 Hsien-Te ..... 439/490

* cited by examiner

*Primary Examiner*—John A Ward
(74) *Attorney, Agent, or Firm*—McGarry Bair PC

(57) ABSTRACT

An illuminated edging system includes an edging section having an upper portion and a lower portion; a light strand (e.g. a rope light) disposed inside the upper portion; and an electrical connector at an end of the light strand and disposed inside the upper portion. The translucent upper portion and the lower portion are integrally formed of plastic. The upper portion and lower portion may be co-extruded so that they are of different materials. A translucent coupler joins adjacent edging sections. The coupler may be formed as a slotted cylinder surrounding the upper portion, the lower portion extending through the slot. A weather-resistant connector may be disposed inside the upper portion of the edging section, protecting the electrical connector.

16 Claims, 10 Drawing Sheets

ILLUMINATED LANDSCAPE EDGING SYSTEM

FIELD OF THE INVENTION

This invention relates to landscape edging products, including without limitation edging for lawns, sidewalks, trees, flower beds and the like, with lighting fixtures integrated therein.

BACKGROUND OF THE INVENTION

Edging is used in a variety of landscaping applications, generally to separate one defined area from another (e.g. a lawn from a flower bed). A profile of a typical edging product 1 is shown in FIG. 1A. The edging is generally made of plastic and has an upper hollow tube portion 2 and a flat lower portion 3. The edging is typically installed so that fins 4 anchor the lower portion 3 in the ground, with only the tube portion 2 visible above grade. Edging 1 is sold in rolls of various lengths (20 feet, 40 feet, 60 feet, etc.) and is typically installed in either a straight or curved path; different sections are coupled together using cylindrical couplers 5 fitted into, or around, the ends of respective tube portions 2. As shown in FIG. 1B, each external coupler 5 fits around the exterior of the tube portions 2 of two adjacent sections of edging, and has a slot 5*a* through which extend the flat lower portions 3. Multiple sections may be joined form edging with a uniform appearance and any desired length. The edging is typically made in a dark or neutral color to visually blend with the landscape.

Flexible strands of lights (sometimes called rope lights) are used in a number of applications for decorative purposes. For example, rope lights are often used in holiday decorations and accent lighting in the home (on deck railings, kitchen cabinets, crown moldings, etc.)

It is desirable to provide edging which integrates outdoor lighting for safety, convenience and appearance. In particular, it is desirable to adapt rope lights or the equivalent for outdoor installation in landscape edging.

SUMMARY OF THE INVENTION

The present invention provides an illuminated edging system including an edging section having an upper portion and a lower portion; the upper portion is an elongated enclosure open only at an end thereof. A light strand (e.g. a rope light) is disposed inside the upper portion, with an electrical connector at an end of the light strand and disposed inside the upper portion. The lower portion is configured to be installed below grad, so that the upper portion with the light strand rests on the ground.

In an embodiment, the upper portion and the lower portion are integrally formed of plastic, and the upper portion is translucent. The upper portion and lower portion may be formed by a co-extrusion process, so that the upper portion is translucent and the lower portion is not translucent.

In an embodiment, the edging system has a plurality of edging sections and a translucent coupler for joining adjacent edging sections, with the coupler disposed on the exterior of the respective upper portions of the adjacent edging sections. The coupler may be formed as a slotted cylinder surrounding the upper portion, the lower portion extending through the slot. A weather-resistant coupling of the rope light may be disposed inside the upper portion of the edging section, between the light strand and the electrical connector.

The foregoing has outlined, rather broadly, the preferred features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claims, and the accompanying drawings in which similar elements are given similar reference numerals:

DETAILED DESCRIPTION

It is to be understood that the invention is not limited in its application to the details of the particular arrangement shown, since the invention is capable of other embodiments. Furthermore, the terminology used herein is for the purpose of description and not of limitation.

Figure 1A:
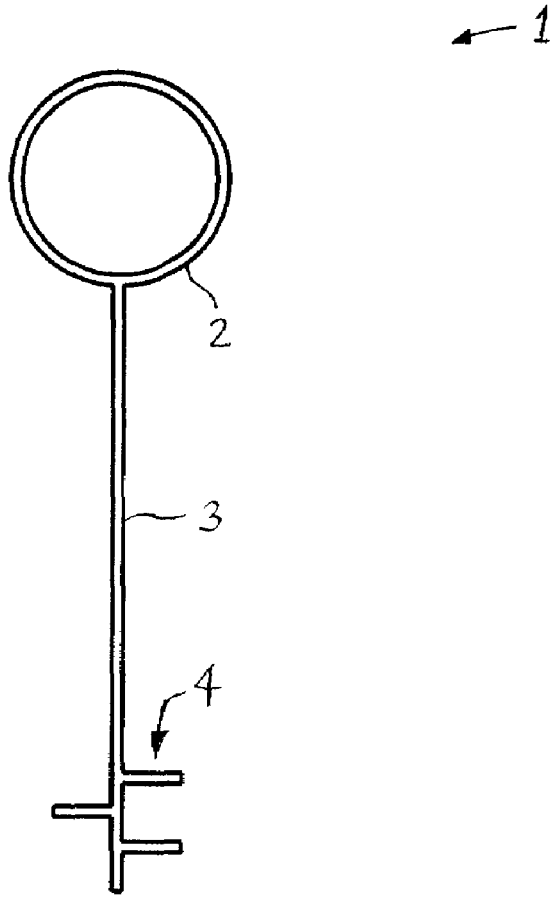
FIG. 1A PRIOR ART
FIG. 1A is a schematic cross-sectional view of a typical edging product.
Figure 1B:
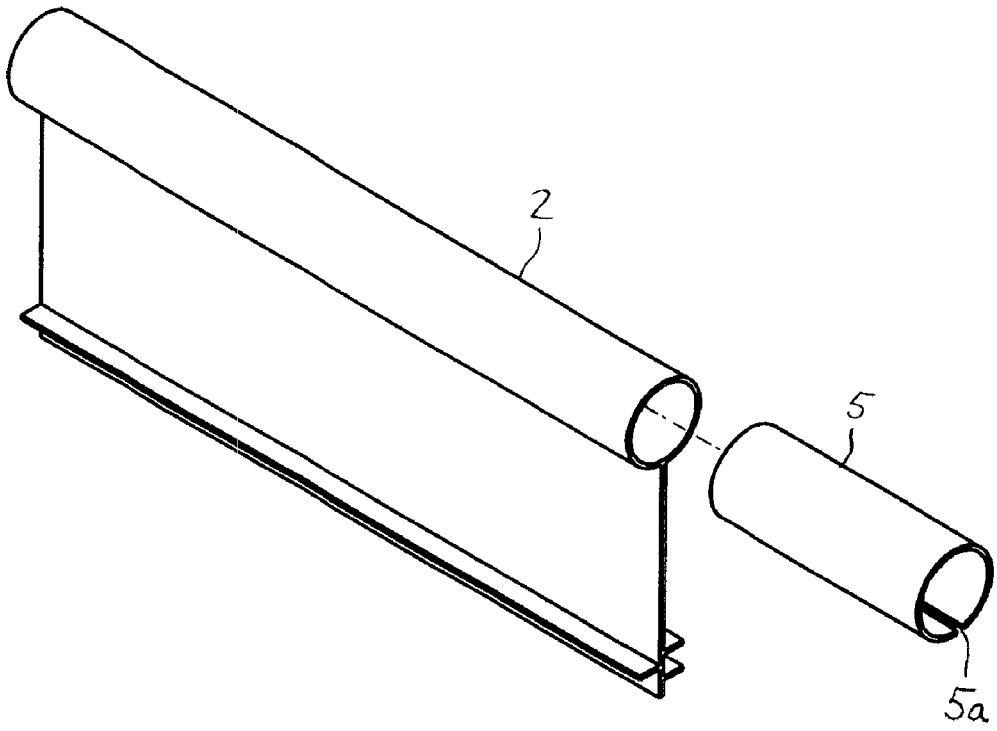
FIG. 1B PRIOR ART
FIG. 1B is a perspective view of a conventional edging system, showing a section of edging and an external slotted coupler.
Figure 2A:
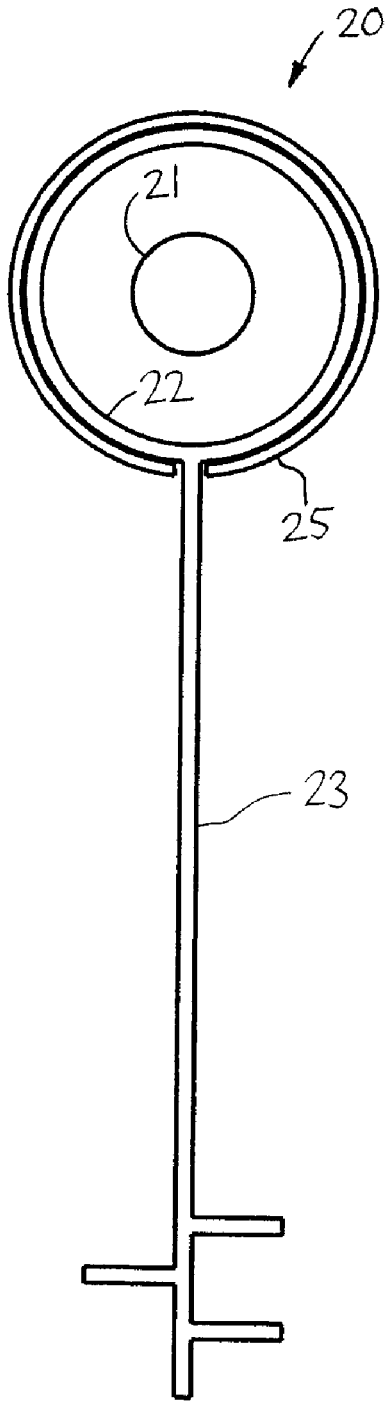
FIG. 2A is a cross-sectional view of edging with an internal light strand, in accordance with an embodiment of the invention.
Figure 2B:
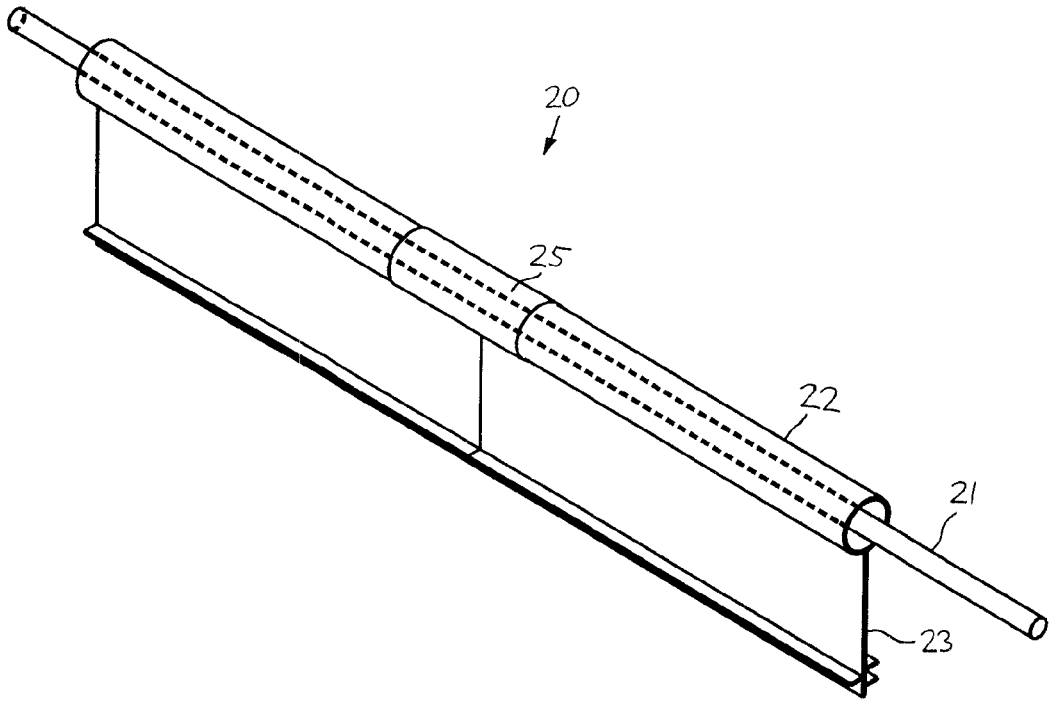
FIG. 2B is a perspective view of two sections of edging with an external coupler and an internal light strand, in accordance with an embodiment of the invention.

An embodiment of the invention is schematically illustrated in FIGS. 2A and 2B. FIG. 2A is a cross-sectional view of a section of edging 20 having an upper tube portion 22 and a lower portion 23. A flexible strand 21 of lights (e.g. rope lights) is installed inside tube portion 22. As shown in FIG. 2B, the tube portion 22 is an elongated enclosure, open only at the ends thereof, and has a substantially circular cross section. The light strand preferably has a circular cross-section, but may have any cross-sectional shape that fits conveniently into tube portion 22.

Sections of the edging 20 are coupled together using a coupler 25. In an embodiment, coupler 25 is an external coupler having the shape of a slotted hollow cylinder surrounding tube portion 22; the lower portion 23 extends downward through the slot. In an alternative embodiment, the coupler is an internal coupler disposed on the interior of the respective upper portions of the adjacent edging sections.

The tube portion 22 and coupler 25 are made of transparent or translucent plastic so that light from strand 21 is visible. In an embodiment, the coupler 25 covers the tube portion 22 only in the vicinity of a joint between two sections of edging, as shown in FIG. 2B. Alternatively, the coupler 25 may be provided in long sections to form a continuous covering of tube portion 22. The tube portion 22 (either along or in combination with the coupler 25) protects the lights from weather and from physical damage (e.g. by weed trimmers, by being stepped upon, etc.). A UV inhibitor may be added to the plastic to protect the rope lights from the sun.

Either of tube portion 22 or coupler 25 may be formed without coloring, or may be colored so as to impart a color to the visible light emanating from strand 21, or from a portion of the strand. Alternatively, the lights of strand 21 may themselves be of a variety of colors. The lights may be incandescent or have light-emitting diodes (LEDs). In an embodiment, tube portion 22 is transparent while a continuous coupler 25 may be any of a variety of colors. The color of the lighted edging may thus by changed by installing a different coupler.

The lower portion 23 of the edging 20 may be formed in an extrusion process along with upper portion 22, so as to have the same translucent properties as the upper portion. Alternatively, the lower portion may be formed in a co-extrusion process so that the upper and lower portions are of different materials; the plastic of the lower portion therefore may be opaque while the upper portion is transparent or translucent. Both the upper and lower portions may also be made transparent.

Figure 3A:
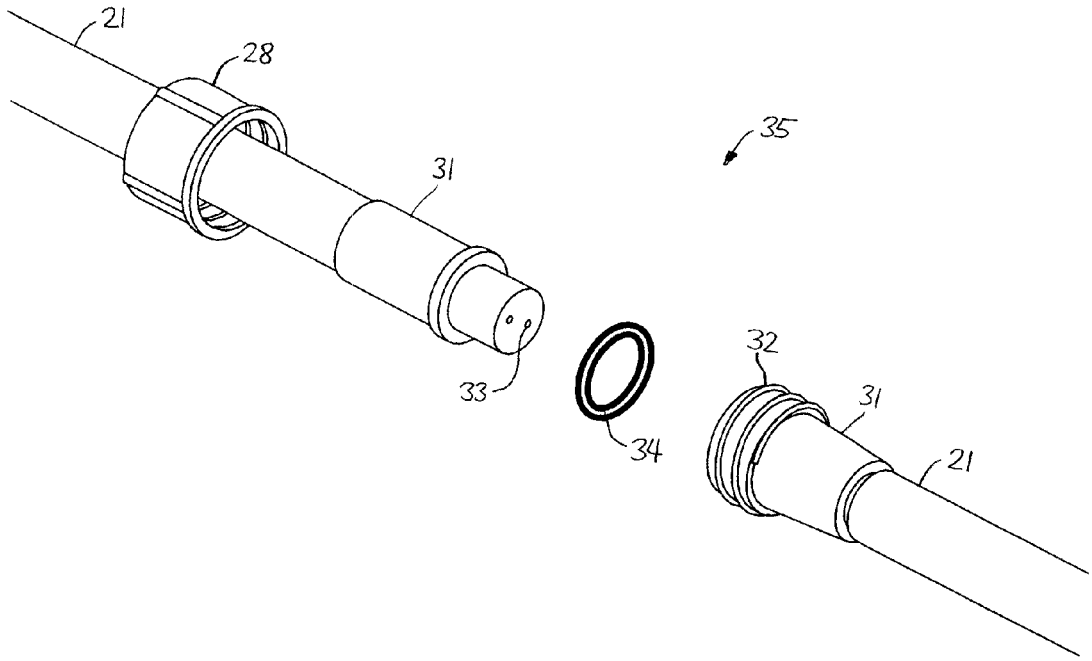
FIGS. 3A and 3B are schematic illustrations of electrical connectors at the ends of a light strand, in accordance with an embodiment of the invention.
Figure 3B:
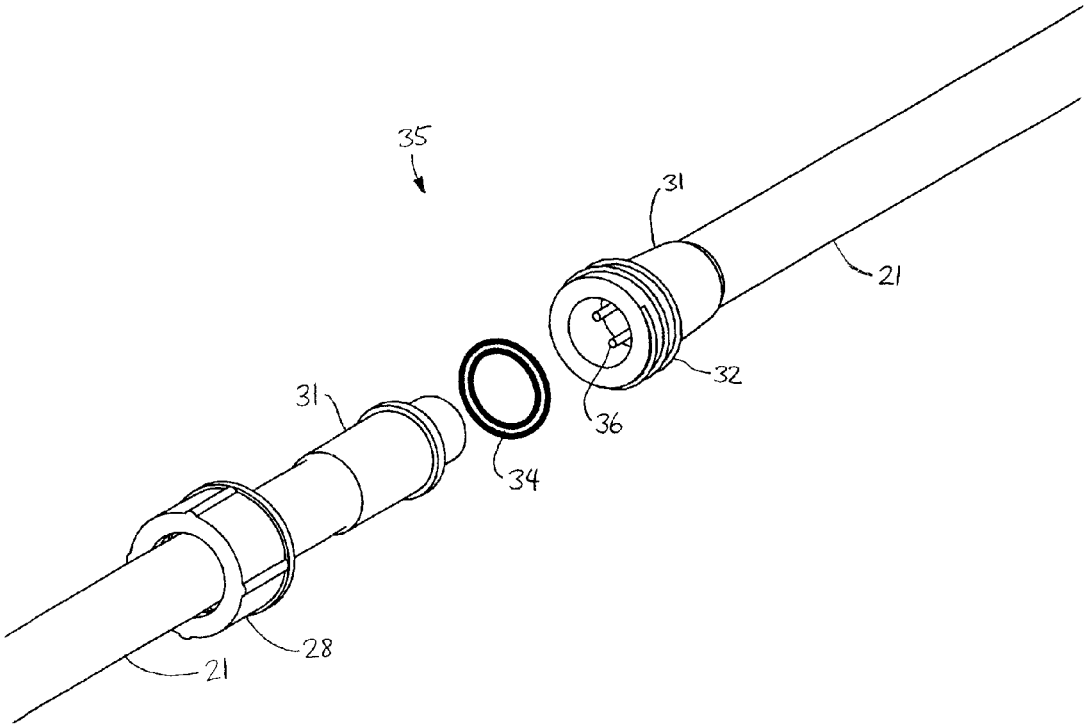
Figure 3C:
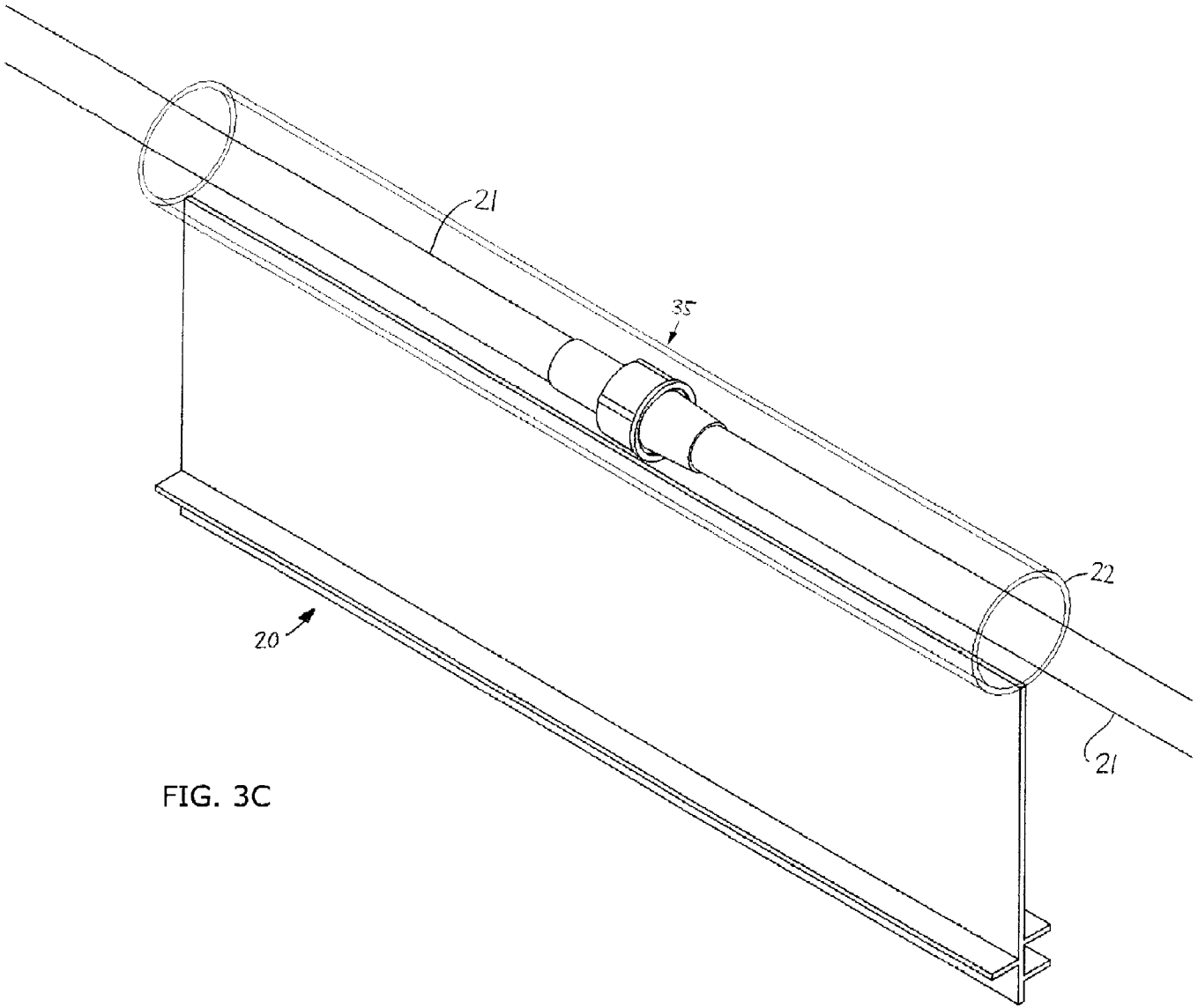
FIG. 3C is a perspective view of a weather-resistant electrical connection in a section of edging, in accordance with an embodiment of the invention.
Figure 3D:
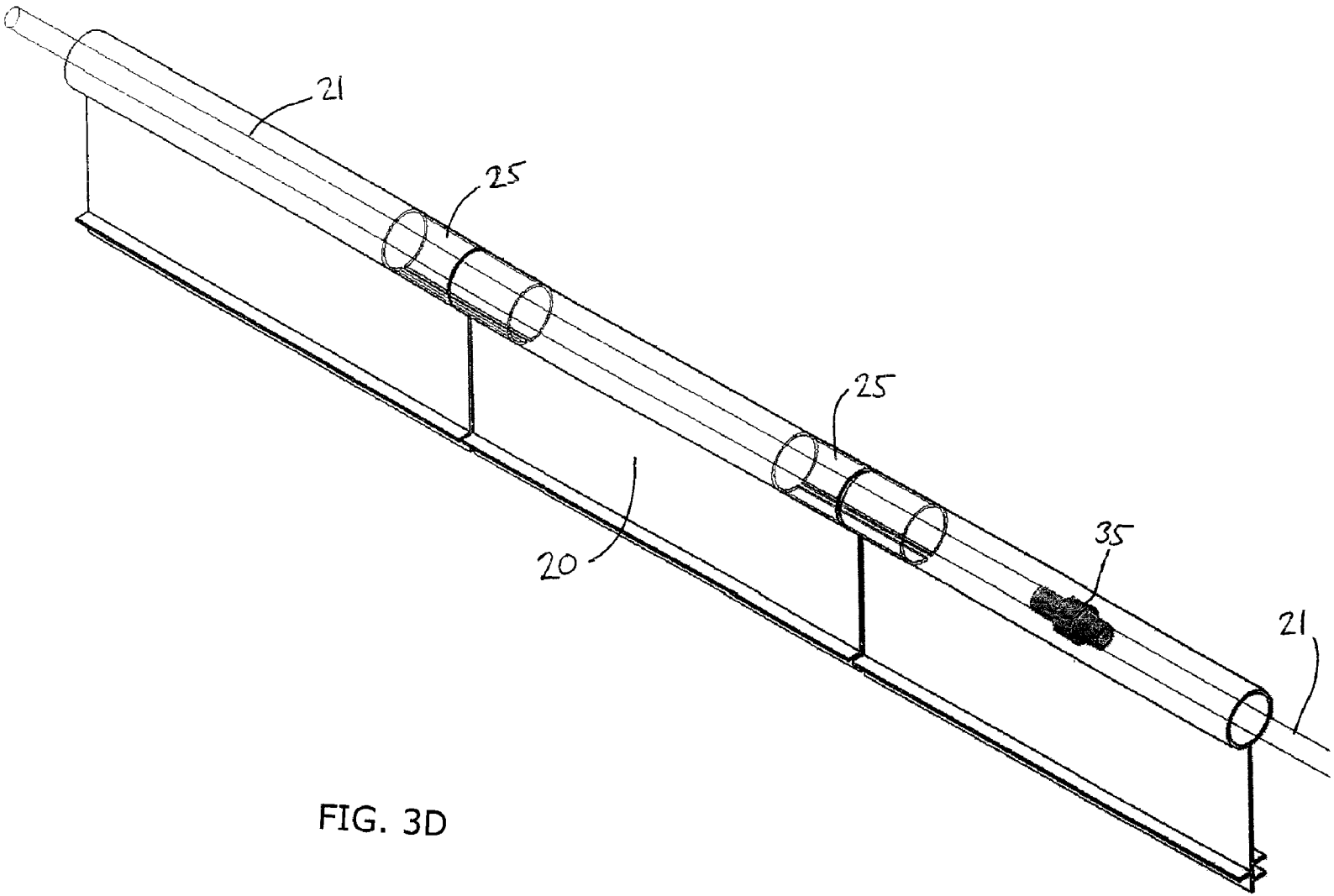
FIG. 3D is a perspective view of multiple edging sections joined by external couplers, with a weather-resistant electrical and mechanical connection between two internal light strands, in accordance with an embodiment of the invention.

In an embodiment, a weather-resistant electrical connector is located at each end of light strand 21, to connect the lights in series. FIGS. 3A and 3B show a connection between two light strands, viewed from different angles. An electrical plug 36 at the end of light strand 21 mates with a socket 33 at the end of a neighboring light strand. The junction between strands is protected by a weather-resistant mechanical connector 35 having two sections 31, fastened together by a coupling nut 28 threading onto a threaded portion 32, and sealed using an O-ring 34. Although FIGS. 3A and 3B illustrate a connection for a two-wire rope lighting strand, other types of light strands are also contemplated, such as (but not limited to) 3-, 4- or 5-wire rope lights. All of the components shown in FIGS. 3A and 3B are sized to fit inside the tube portion 22 of the edging 20, so that the connectors when in use are protected both by the tube portion 22 and the coupler 25. Thus, when the edging 20 is installed, only the tube portion 22 (with light shining therefrom) and the coupler 25 are visible above grade. FIG. 3C is a perspective view of a weather-resistant connector 35 joining two light strands 21 inside a tube portion 22 of an edging section 20. As shown in FIG. 3D, a single light strand may extend through the tube portions of several edging sections. Couplers 25 provide a mechanical connection between adjacent edging sections, while connectors 35 provide a weather-resistant mechanical and electrical connection between light strands.

Figure 4A:
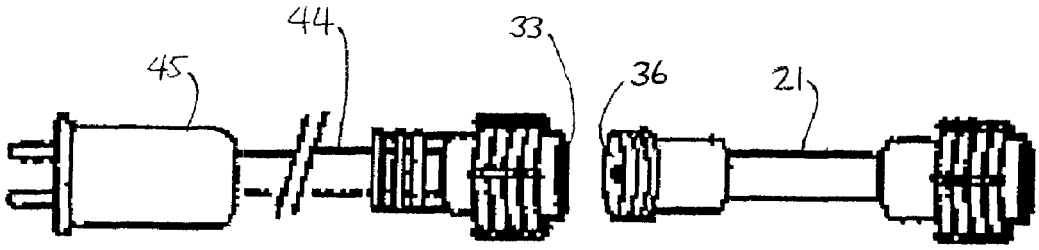
FIG. 4A schematically illustrates a connector for a light strand to a power cord and plug, for connecting the lighting portion of the edging to a power source.
Figure 4B:
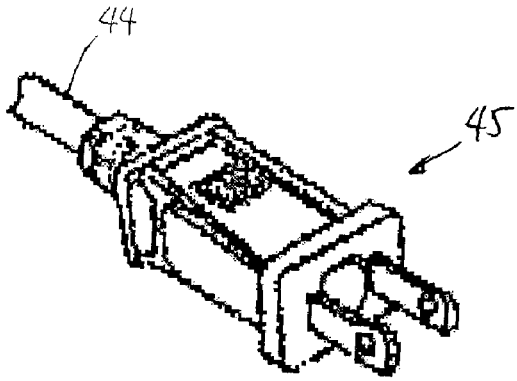
FIG. 4B is a detail view of the power plug shown in FIG. 4A.

In an embodiment, one end of the edging has a connector for making an electrical connection to a power source, as schematically illustrated in FIG. 4A. Plug 36 mates with socket 33, with the electrical connection covered by coupling nut 28 threading onto thread 32, as described above. Socket 33 in turn is coupled to power cord 44 and plug 45, as shown in FIG. 4B. Plug 45 typically is polarized, and may advantageously have a fuse (e.g. a 2 W-5 W fuse) incorporated therein. Although plug 45 as shown is configured for connecting to a 120V power source, it will be appreciated that a low-voltage power source may be used instead, depending on the power requirements of light strand 21. In another embodiment, the light strand is solar-powered, and connects to a solar collector/generator rather than an external power source.

Figure 5:
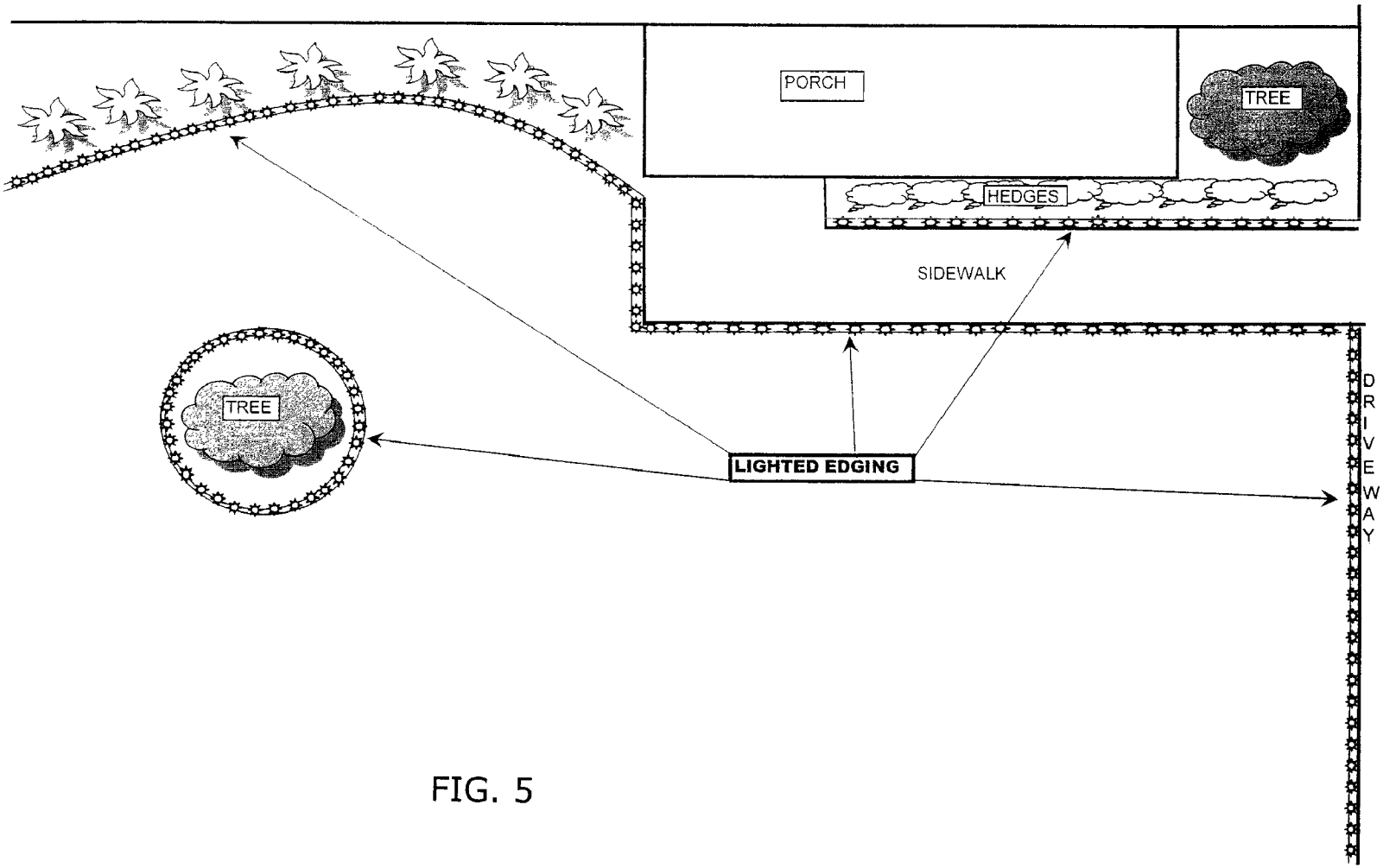
FIG. 5 schematically illustrates an installation of lighted edging in accordance with an embodiment of the invention.

Illuminated edging in connected sections, as described above, provides inexpensive, ground-level outdoor lighting. One possible installation is shown schematically in FIG. 5, where both edges of a sidewalk are illuminated, and accent lighting surrounds a tree.

While the invention has been described in terms of specific embodiments, it is evident in view of the foregoing description that numerous alternatives, modifications and variations will be apparent to those skilled in the art. Accordingly, the invention is intended to encompass all such alternatives, modifications and variations which fall within the scope and spirit of the invention and the following claims.

I claim:

1. An edging segment for an illuminated landscape edging system comprising:

an upper tube portion open only at its axial ends, the upper tube portion having one of a translucent and a transparent portion, a lower portion extending axially along the upper tube portion and radially therefrom and adapted to be installed in the ground, a rope light strand extending through the upper tube portion, the rope light strand having an electrical connector for connecting to another rope light strand, and a tubular coupler disposed at an axial end, configured to couple the upper tube portion to an upper tube portion of an adjacent edging segment, whereby when two edging segments are adjoined, the rope light strand can extend through the upper tube portions of both edging segments with the electrical connector disposed within one of an upper tube portion and a coupler.

2. An edge segment for an illuminated landscape edging system according to claim 1, wherein the upper tube portion and the lower portion are integrally formed of plastic.

3. An edge segment for an illuminated landscape edging system according to claim 2, wherein the upper portion and lower portion are formed by a co-extrusion process.

4. An edge segment for an illuminated landscape edging system according to claim 1, wherein the lower portion is configured to be installed below grade.

5. An edge segment for an illuminated landscape edging system according to claim 1, wherein the upper tube portion has a substantially circular cross section.

6. An edge segment for an illuminated landscape edging system according to claim 1, wherein the coupler is formed as a slotted cylinder surrounding the upper tube portion, the lower portion extending through the slot.

7. An edge segment for an illuminated landscape edging system according to claim 1, wherein the coupler has one of a transparent and a translucent portion.

8. An edge segment for an illuminated landscape edging system according to claim 1, wherein the upper tube portion is substantially transparent and the coupler has a color other than transparent, so that light from the edging system has a color in accordance with the color of the coupler.

9. An edge segment for an illuminated landscape edging system according to claim 8, wherein the upper tube portion has an upper tube portion longitudinal length, and the coupler has a coupler longitudinal length, and the coupler longitudinal length is at least as long as the upper tube portion longitudinal length.

10. An edge segment for an illuminated landscape edging system according to claim 9 and further comprising a plurality of couplers, each having a color distinct from one another, wherein a coupler of a selected color can be removably attached to the edging section upper portion.

11. An edge segment for an illuminated landscape edging system according to claim 1, wherein the electrical connector further comprises a weather resistant mechanical connector for making a weather-resistant series connection to a neighboring light strand.

12. An edge segment for an illuminated landscape edging system according to claim 1, further comprising a power connector for connecting said electrical connector to a power source.

13. An edge segment for an illuminated landscape edging system according to claim 12, wherein the power source is a solar generator.

14. An edge segment for an illuminated landscape edging system according to claim 1, wherein the lower portion has one of a translucent and a transparent portion.

15. An edge segment for an illuminated landscape edging system according to claim 1 and further comprising a plurality of couplers, each having a color distinct from one another, wherein a coupler of a selected color can be removably attached to the edging section upper portion.

16. An edge segment for an illuminated landscape edging system according to claim 1, wherein the electrical connector is disposed within the tubular enclosure.

* * * * *